US005477802A

United States Patent [19]

Laue

[11] Patent Number: 5,477,802

[45] Date of Patent: Dec. 26, 1995

[54] PORTABLE BOAT RAMP

[76] Inventor: Billy D. Laue, 402 Rose Ave., Crane, Mo. 65633

[21] Appl. No.: 362,977

[22] Filed: Dec. 23, 1994

[51] Int. Cl.[6] ..... B63B 59/02

[52] U.S. Cl. ..... 114/219; 405/1

[58] Field of Search ..... 405/1, 7; 114/343, 114/344, 219, 361; 188/6, 7, 8, 32

[56] References Cited

U.S. PATENT DOCUMENTS

| | | | |
|---|---|---|---|
| 2,658,354 | 11/1953 | Lee | 405/1 |
| 3,579,996 | 5/1971 | Edson | 405/1 |
| 4,260,282 | 4/1981 | Dorsey et al. | 405/1 |
| 4,449,846 | 5/1984 | Price | 405/7 |
| 4,468,150 | 8/1984 | Price | 405/7 |
| 4,696,250 | 9/1987 | Antonides | 405/1 |
| 4,803,942 | 2/1989 | Dren et al. | 405/1 |
| 4,972,791 | 11/1990 | Williams | 405/1 |
| 5,067,428 | 11/1991 | Dickerson et al. | 405/1 |

*Primary Examiner*—Stephen Avila
*Attorney, Agent, or Firm*—Terrance L. Siemens

[57] ABSTRACT

The present invention relates to a novel portable lightweight boat ramp. The boat ramp is made up of two metal frame halves which open from the inside out, to form a V-shape angle matching the contour of a small boat approaching the beach area for landing. Each metal frame half is covered by a flat panel, made of strong and durable material, and each flat panel is covered in turn by a thin layer of frictionless material, so as to prevent the device from scratching the hull of the landing boat. In addition, four legs are hinged to the two metal frame halves, and are deployed to an obtuse angle with respect to the metal frame halves when the device is opened up for receiving an incoming boat for landing.

8 Claims, 4 Drawing Sheets

PORTABLE BOAT RAMP

BACKGROUND OF THE INVENTION

1. Field of the Invention

The present invention relates to a small, lightweight and portable boat ramp made to fold when not in use for transportation and storage and to deploy easily for permitting a small boat to land on a gently sloping beach area. It has characteristics which have not been matched in the prior art, and which render the device highly effective in its objective of permitting a smooth boat landing. As such, the device is useful in the fields of fishing or recreational boating.

A comprehensive listing of all the possible fields to which this invention may be applied is limited only by the imagination, and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields, or to the specific examples of potential uses presented hereinafter.

2. Description of the Prior Art

U.S. Pat. No. 2,658,354, issued to Donovan A. Lee on Nov. 10, 1953, shows a portable boat launching and beaching apparatus, comprising several rollers, mounted on two vertically installed shafts, for receiving a small boat on a ground surface. The two vertical shafts, which support the rollers, are designed to be driven into the ground, thereby securing the device to the ground. The instant invention offers, in contrast, a collapsible device which is made to rest on the ground surface, and because of its larger planar dimensions, as opposed to the small shaft cross-section of the already patented device, provides better adherence to the ground surface.

U.S. Pat. No. 3,579,996, issued to Jerry W. Edson on May 25, 1971, presents a portable boat ramp, and offers a device which depends on two grooves for receiving the hull of a small boat, and on two lateral cushions for supporting the hull. In contrast to the patented design, the instant invention offers a larger supporting area that will be more effective in preventing damages to the hull.

A portable boat ramp is offered by U.S. Pat. No. 4,260,282, issued to Charles L. Dorsey on Apr. 7, 1981. The patented device has a converging set of walls for raising the boat above water when beaching the boat, thereby requiring a strong amount of upward thrust to lift the boat above water. By contrast, the instant invention provides a smooth upward lift of the boat, because it matches the gentle rise of the beach area where the user docks his boat.

U.S. Pat. No. 4,449,846, issued to James W. Price on May 22, 1984, offers a transverse saddle type boat cradle, having vertically erected hull support panels designed to fit the contour of a particularly shaped hull. By contrast, the instant invention proposes an easily deployable boat ramp, one that has no vertical member. Further, the patented device is designed for docking the boat, rather than for ramping it on a beach surface.

U.S. Pat. No. 4,468,150, issued to James W. Price on Aug. 28, 1984, offers another adjustable cradle for supporting and stabilizing boats. It has a base frame structure with several adjustable vertical support assemblies, strategically located to match the contour of the boat hull. The instant invention is quite simple and differs from the patented device, because it has no vertical elements.

John E. Antonides was issued U.S. Pat. No. 4,696,250, on Sep. 29, 1987, for a portable boat ramp for small watercraft. It offers a gently sloping hull receiving cradle, to be anchored to the ground by a set of four spikes. In contrast to our invention, it is not meant to be collapsed into a small package for transportation or for storage.

U.S. Pat. No. 4,972,791, issued to Gary P. Williams on Nov. 27, 1990, shows a pair of plates pivotally attached together to form a V-shaped boat support configuration. The patented device is a dry dock, rather than a ramp for beaching the boat, and the plates open inside out to form a V-shaped support. By contrast, the instant invention has two metal frame halves which open from the outside to the inside, where the two metal frame halves are prevented from opening beyond the V-angle required to support the beaching boat by having the two metal frame halves butt against each other when the desired opening angle is reached. By contrast to the instant invention, the already patented device, as a dock, is bulky and heavy. In the instant invention, a means, not provided by the patented device, is provided for hand-carrying the boat ramp to a desired location, and for deploying it in order to receive an incoming boat ready to land on the beach.

U.S. Pat. No. 5,067,428, issued to Mack F. Dickerson on Nov. 26, 1991, shows a portable boat dock which consists of a modified H-shaped frame designed to support a beaching boat. The frame has two angled legs spaced apart to penetrate a short depth into the ground. It has a third member attached to the H-frame to form the long arm of a tee, designed for pulling the dock, and for anchoring the dock so that it ends up having the right landing configuration on the ground. By its very nature this dock is bulky and difficult to carry. By contrast, the instant invention proposes a boat ramp that is light, portable and collapsible, and which can quickly be deployed for receiving a boat hull.

None of the above inventions and patents, taken either singly or in combination, are therefore seen to describe the instant invention as claimed.

SUMMARY OF THE INVENTION

Briefly, the invention is for a device which is hand portable, and which can be quickly deployed and installed on the beach, in order to receive an incoming small boat out of the water, without otherwise harming its hull. It has a metal frame made into two halves, which are hinged along their inside dimension, and which have two legs each at their outside dimension. The two legs open up to form an obtuse angle with respect to the metal frame halves so as to penetrate partially into the beaching surface.

In addition, the invention has two flat panels made of durable material, such as exterior plywood, attached to the two metal frame halves. The flat panels are covered with a frictionless material, such as Teflon or felt, whose purpose it is to prevent scratching the boat hull, while performing the beaching operation on the ground.

This invention also includes a handle for carrying the device, and also for helping deploy it when necessary on the beach. Said handle is made into two portions of unequal lengths, and a flexible tube is made to ride the handle, hiding the split between the two handle portions when carrying the device, and otherwise disclosing the split for deployment when installing the device on the beach.

Accordingly, it is a principal object of the invention to provide a new and improved device for beaching a small boat, which overcomes the disadvantages of the prior art, in both a simple and effective manner.

It is a major object of this invention to provide a portable boat ramp providing means of ramping a small boat on a beach.

It is another object to provide a portable boat ramp which is collapsible to a small package, for hand transporting the device prior to its installation on the beach.

It is another object to provide a boat ramp which is manually deployable when in use on the beach.

It is another object of the invention to provide a boat ramp made of two metal frame halves, hinged together along their interior dimension.

It is another object of the invention to provide a boat ramp, the halves of which open up to form a V-shape angle to match the contour of a small boat hull.

It is another object of the invention to provide a boat ramp with two metal frame halves opening to an angle such that the halves butt against each other preventing further opening of the halves, and presenting a stable landing angle configuration.

It is another object of the invention to provide a boat ramp with a combined carrying handle and locking means for carrying and locking the ramp in a folded position.

Finally, it is a general goal of the invention to provide improved elements and arrangements thereof in an apparatus for the purposes described which is inexpensive, dependable, and which is simple and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

Figure 1:
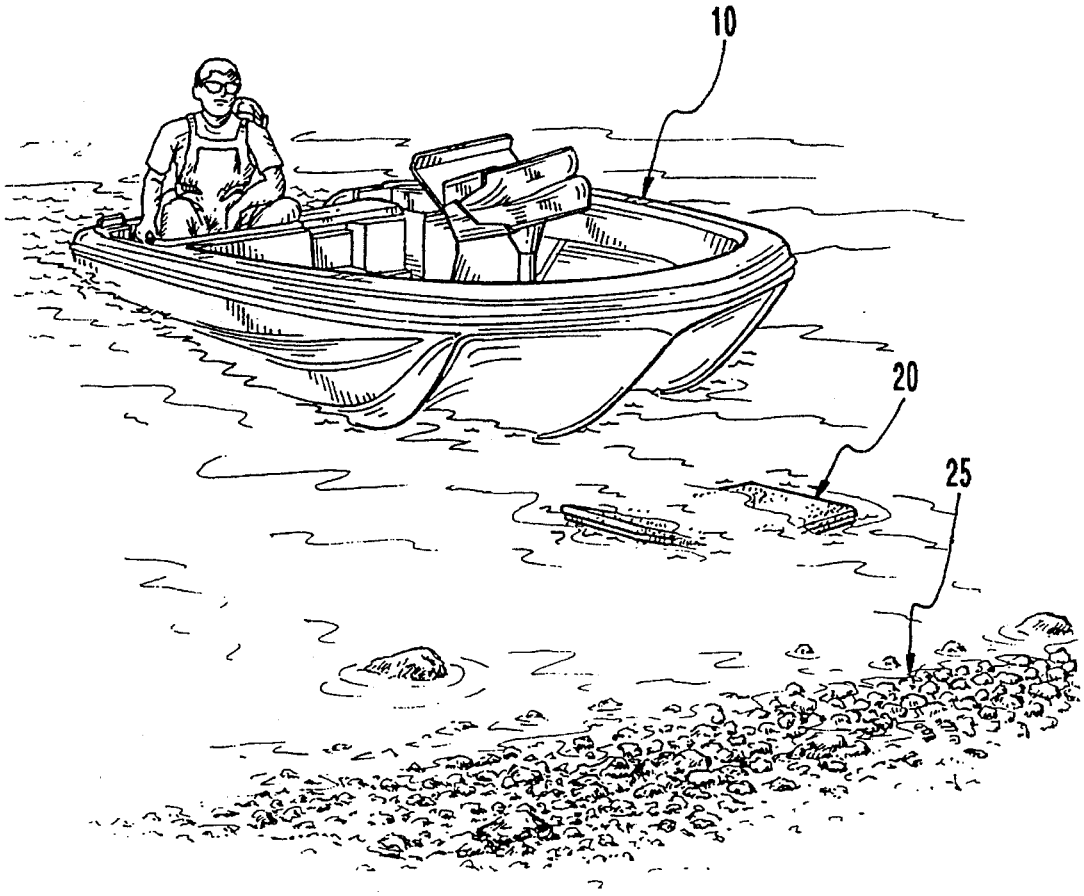
FIG. 1 is an environmental perspective view, showing a small boat approaching the device which is installed and deployed on the beach, and which is partially submerged in the water, and partially sunk into the ground, ready to receive the incoming boat.

FIG. 1 shows an incoming small boat 10 slowly approaching the device 20, already installed in its fully deployed configuration to receive the boat 10. It is shown partially submerged in the water, with its two halves open to receive the incoming boat. The landing area 25 can be a beach area covered with sand, gravel or pebbles, and presenting a gently sloping angle to the incoming boat.

Figure 2:
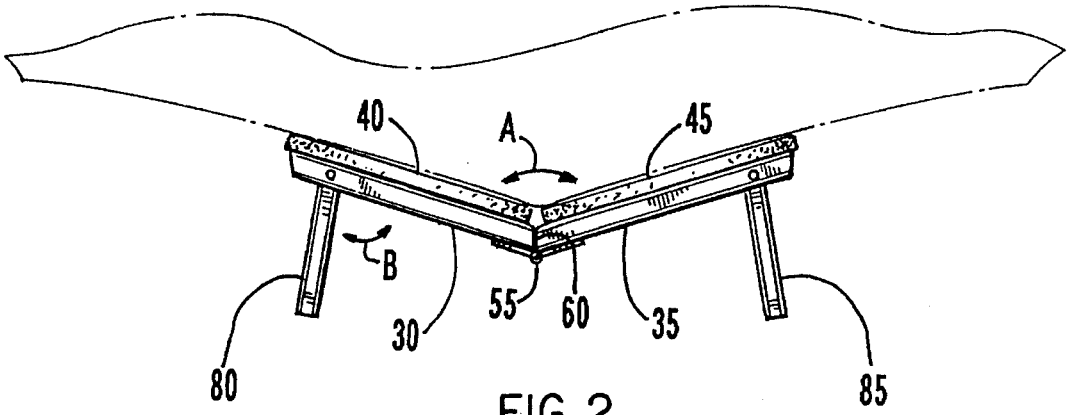
FIG. 2 shows the device as seen from the incoming end of the boat, with the two metal frame halves opened up to their maximum opening angle, to form a V-shaped contour for matching an incoming boat hull, and with two legs on opposite sides in the partially opened position.

In FIG. 2 two metal frame halves 30 and 35 are opened around hinge 55 so as to form a V-shaped surface matching the contour of an incoming boat. The V-shaped angle is shown as angle A. Two flat panels 40 and 45, are attached to the top of each metal frame half 30 and 35. The top of the device in this fully deployed configuration folds to form the outside surfaces when fully folded for transportation. Hinge 55 joins the two metal frame halves 30 and 35 at the middle. The maximum V-shaped angle A is obtained when the two metal frame halves 30 and 35 butt each other at 60. Two folding legs 80 and 85 (shown partially unfolded) form an obtuse inside angle B with respect to each metal frame half 30 and 35 when fully unfolded.

Figure 3:
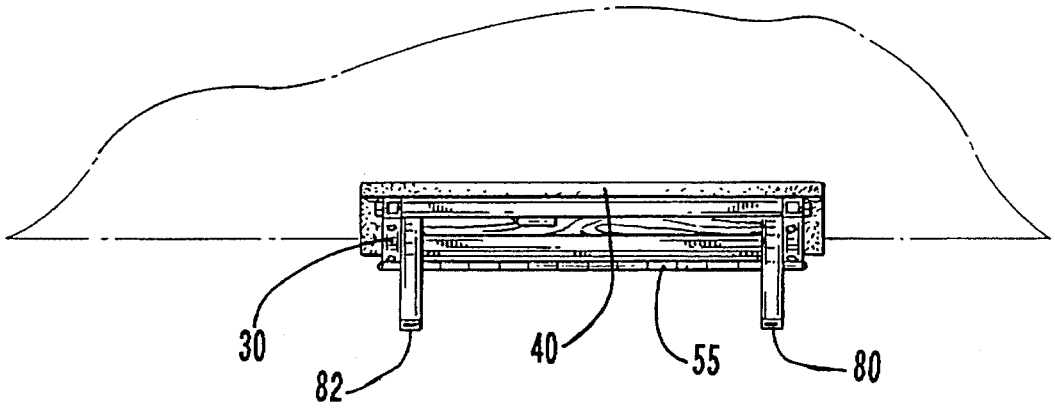
FIG. 3 shows a side view of the device with a pair of legs shown fully deployed.

In FIG. 3 two folding legs 80 and 82 are shown thrust forward of the plane of the figure, attached to one metal frame half 30. The bottom of flat panel 40 is visible in this view. The edges of panel 40 are seen to extend a small distance beyond from the metal frame halves to the outside. It is desired to prevent any portion of the metal frame from contacting the boat hull during docking. Hinge 55 is shown as a single long piano type hinge for rigidity. The artisan will recognize that two smaller door type hinges could as well be used.

Figure 4:
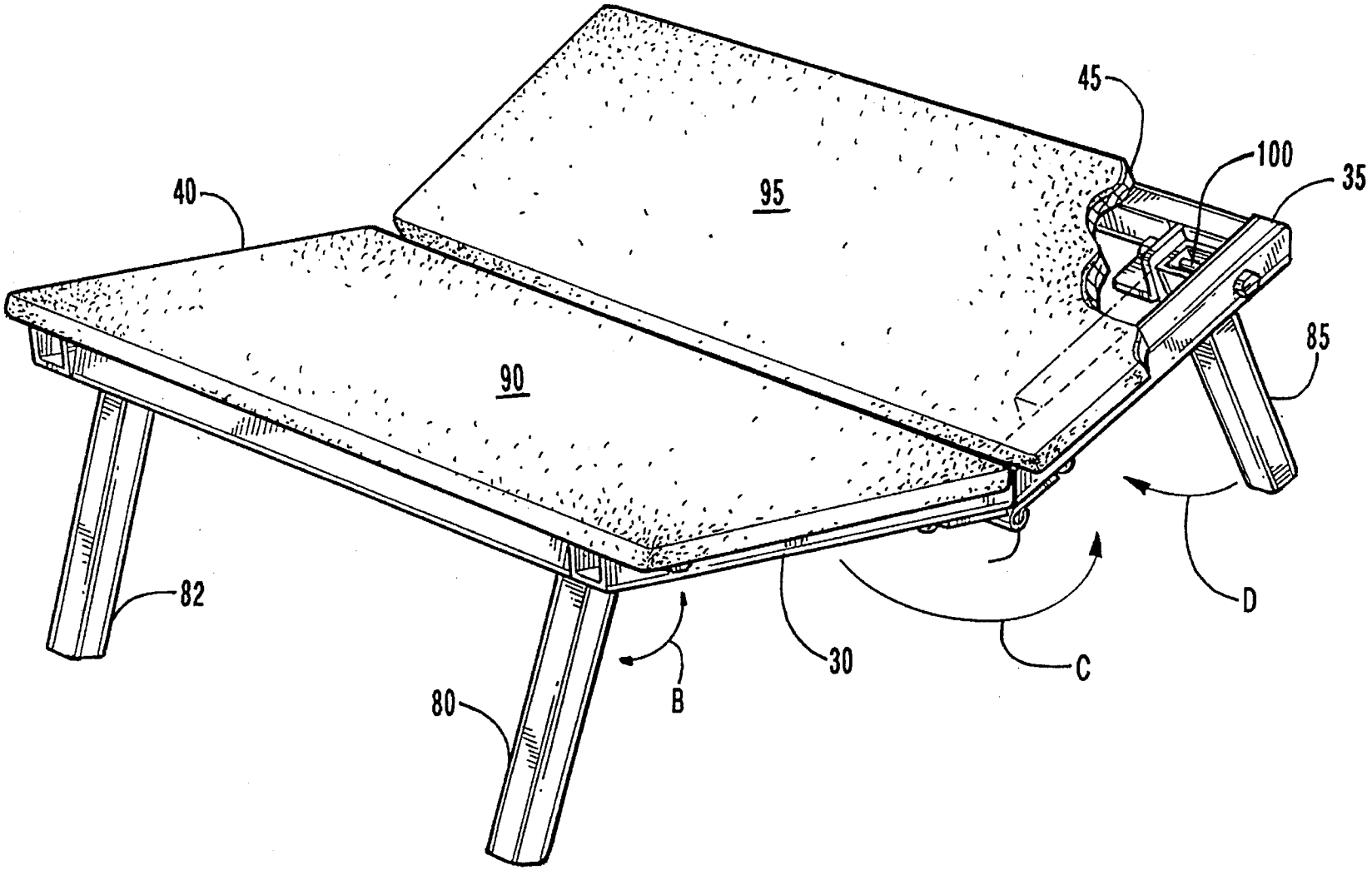
FIG. 4 is a perspective view of the device partially broken away to show the details of a folding leg as it is opened up for deployment to receive a landing boat.

In FIG. 4 the metal frame halves 30 and 35 are shown in the fully deployed position, with the central hinge at 55, the two flat panels 40 and 45, and a pair of legs on one side, shown at 80 and 82, and single one of the other pair of legs visible at 85. Each leg is made to pivot about the metal frame around hinge bolt 100. The legs can be folded to lie flat against the corresponding panel and swung open to an obtuse angle B. The folding deployment of the two sides is shown by arrow C, and the folding deployment of representative leg 85 is shown by arrow D. Each frame half 30 and 35 can be made of light tubular metal in a typical embodiment of the invention. A covering of low friction padding material covers each flat panel, as shown at 90 and 95. The padding material is intended to prevent scratching the boat hull while at the same time allowing easy riding of the hull onto the platform formed by the device. The legs fold outward to an obtuse angle to give greater stability to the platform as it is wedged into the beach by the weight of the boat. The obtuse angle tends to defeat any tendency of the legs to return to their flat folded position by forces derived from the docking.

Figure 5:
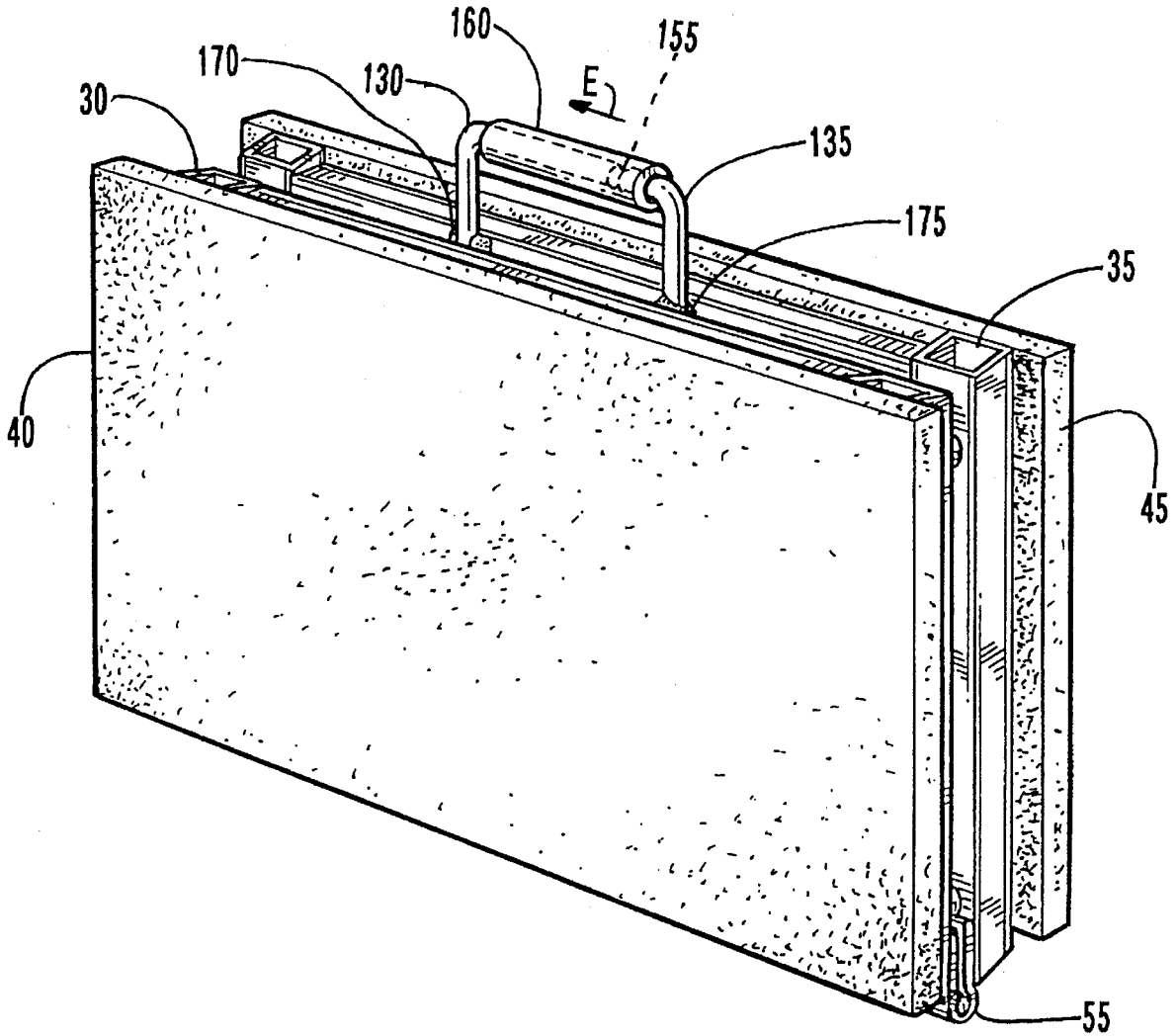
FIG. 5 shows the device in its fully collapsed configuration for transportation and storage, and showing the carrying handle and locking means.

In FIG. 5 the device is shown fully collapsed for transportation and storage. A carrying handle is made of two L-shaped portions 130 and 135 with each portion welded to an opposite frame half. The distal ends of handle portions 130 and 135 lie in aligned close proximity to one another when the ramp is in the fully folded position, forming a narrow slot or split 155. The split between the two handle portions is covered by a piece of flexible tubing 160. The tubing 160 covers the two aligned metal handle portions when the device is fully folded for transportation or storage and forms a convenient and comfortable carrying handle, as shown in FIG. 5. Flexible tubing 160 is pushed out of the way to expose split 155 and the two handle portions are pushed away from each other to unfold the device for use. Welded areas of the handle portions to their corresponding metal frame halves are shown at 170 and 175. Arrow E shows the direction flexible tubing 160 is pushed toward the longer aligned handle half portion 130 for separation of the two handle halves and deployment of the device. Thus it can be seen the handle device serves the dual function of locking the ramp in its folded position and providing a convenient carrying handle for the folded ramp.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, each pair of legs can be linked together by a longitudinal member, welded at its two ends to each of the two legs, and which could offer the following two advantages. The first advantage could enable the user to deploy each pair of legs simultaneously, as opposed to deploying them individually, in order to increase the speed of deployment of the device on the beach. The second advantage is that, with the two longitudinal members thus welded to each pair of legs, and matching the slope of the landing area, the two longitudinal members put a limit onto how deep the two legs will sink into the ground, thereby offering a more stable landing surface than without the longitudinal members installed.

It is to be understood that the present invention is not limited to the sole embodiment described above, but encompasses any and all embodiments within the scope of the following claims:

I claim:

1. A portable boat ramp device, comprising;

a collapsible metal frame means for supporting a bow of a small boat on a beach;

two flat panels for engaging the bow of the boat, and attached to the metal frame, a soft covering over said flat panels for receiving a hull of the boat without scratching its surface, and a carrying means for manually transporting said boat ramp device where said carrying means is made in two portions, one shorter than the other and facing each other along a split end where each point is welded to a corresponding metal frame half, and where a semi-flexible tube rides along said handle portions of unequal lengths, covers said split between the two handle portions in a locking and carrying configuration, and otherwise exposes said handle portions for opening and unfolding said boat ramp device.

2. The device of claim 1, where said metal frame includes two rectangular metal halves having outside corners, with a hinge connecting the two halves along a longitudinal inside dimension, and with four deployable legs hinged at each of said outside corners of said halves, such as to fold for carrying the device, and to unfold to permit said panels to form a V-shaped cradle for receiving the small boat hull, with said four legs thus deployed resting on the beach.

3. The device of claim 2 where said halves of said frame are hinged along said longitudinal dimension, and wherein said hinge is V-shaped so as to provide a limiting position of said halves along said hinge, said limiting position to prevent the said panels from otherwise collapsing upon each other, and where said legs have a folded and an unfolded position, and are positioned at an obtuse angle with respect to said metal frame halves in said unfolded position, so that said legs, when fully unfolded, are thrust into an outward and self-locking stable configuration by the weight of the boat hull, when resting on the beach surface.

4. The device of claim 1, where said flat panels are made of exterior plywood for strength and durability, and where said soft covering of said flat panels is made of a thin sheet of low friction material, to prevent scraping the surface of the small boat hull.

5. A portable boat ramp device, comprising:

a collapsible metal frame means, for supporting the bow of a small boat, two flat panels for engaging the bow of the boat, and attached to the metal frame, a soft covering over said flat panels for receiving a hull of the boat without scratching its surface, a hinge means for rotatably interconnecting said flat panels, and carrying means made in two portions, one shorter than the other, and where each portion is welded to a corresponding metal frame half, and where a semi-flexible tube rides along said handle portions of unequal lengths, hides the split between the two handle portions in the carrying configuration, and otherwise exposes said handle portions for opening and unfolding said boat ramp device.

6. A device, as in claim 5, further comprising a carrying means for manually transporting said device.

7. A portable boat ramp device, comprising;

a collapsible open metal frame means for supporting a bow of a small boat on a beach, said open metal frame means including two rectangular metal halves having outside corners;

four deployable legs pivoted to each of said outside corners of said halves;

two flat panels for engaging the bow of the boat, and covering said open metal frame means;

a soft covering on one side of said flat panels for receiving a hull of the boat without scratching its surface, and hand carrying means for manually transporting said boat ramp device;

hinge means connecting said two halves along a common longitudinal inside dimension, such as to fold said panels substantially adjacent and parallel to one another with said soft covering facing outward and with said legs folded inside said panels for carrying the device, and to unfold with said soft covering facing upward forming a V-shaped cradle with said four legs deployed resting on the beach for receiving the boat hull.

8. The device of claim 7, wherein said hinge means include stop means for positively limiting an opening movement of said halves to positively hold said panels in the shape of said V-shaped cradle when the weight of the boat presses downwardly on said panels, and said legs have a folded and a deployed position, and are positioned at an obtuse angle with respect to said metal frame halves in said deployed position, so that said legs, when fully deployed, are thrust into an outward and self-locking stable configuration by the weight of the boal, when resting on the beach.

* * * * *